United States Patent [19]

Cavagnino

[11] Patent Number: 4,589,949

[45] Date of Patent: May 20, 1986

[54] LABEL GRASPING AND TRANSFERRING DEVICE IN A LABELLING MACHINE FOR BOTTLES AND THE LIKE

[76] Inventor: Pietro Cavagnino, Viale Italia 44, I-14053 Canelli (Asti), Italy

[21] Appl. No.: 701,685

[22] Filed: Feb. 14, 1985

[30] Foreign Application Priority Data

Feb. 17, 1984 [IT] Italy ..... 67159 A/84

[51] Int. Cl.[4] ..... B65C 9/16

[52] U.S. Cl. ..... 156/568; 118/220; 118/231; 156/571; 156/578; 156/DIG. 32; 271/33

[58] Field of Search ..... 156/567, 568, 571, 578, 156/DIG. 31, DIG. 32; 271/33; 118/220, 230, 231

[56] References Cited

U.S. PATENT DOCUMENTS

| | | | |
|---|---|---|---|
| 4,025,067 | 5/1977 | Schlacht | 156/568 |
| 4,298,422 | 11/1981 | Zodrow | 156/568 |
| 4,336,098 | 6/1982 | Zodrow | 156/568 |

FOREIGN PATENT DOCUMENTS

| | | | |
|---|---|---|---|
| 2807359 | 8/1978 | Fed. Rep. of Germany | 156/571 |
| 68179-A/78 | 11/1979 | Italy . | |

*Primary Examiner*—Michael Wityshyn
*Attorney, Agent, or Firm*—Young & Thompson

[57] ABSTRACT

A device for grasping and transferring the labels from the store to the applicator drum of a labelling machine with stationary store, for bottles and the like, which comprises a single transfer member, having at least two curved plates rigidly connected to one another, and situated in a space comprised between the store, the applicator drum and a glueing roller; the transfer member is rotatably mounted on a crank support and is connected, in rigid rotational relationship, to a crown of rollers engaging a stationary cam with concave lobes, having a number of lobes higher than the number of rollers; the distances between the parts, their rotation speed and the profile of the cam are chosen in such a manner that each plate of the transfer member, in successive phases of its displacement, slides in contact relationship with the glueing roller, thus becoming covered with glue, and then abuts by one of its ends against the first label in the store, rolls thereon without substantial slip, while removing the label from the store, and finally abuts by one end against the applicator drum and rolls thereon, thereby transferring to it the conveyed label.

8 Claims, 10 Drawing Figures

LABEL GRASPING AND TRANSFERRING DEVICE IN A LABELLING MACHINE FOR BOTTLES AND THE LIKE

BACKGROUND OF THE INVENTION

This invention relates to a device for grasping and transferring the labels from a store to an applicator drum, in the labelling machines having a stationary store for the labels and intended to label bottles and the like.

In the conventional labelling machines, the label store was made to oscillate in synchronism with the rotation of an applicator drum so as to transfer onto said drum, one by one, the labels contained in the store. However, the need for oscillating the label store, which has a heavy mass, hindered the attainment of high labelling speeds. To improve this situation, devices have been proposed for transferring the labels, one by one, from a stationary store to the applicator drum, by means of a number of vanes peripherically mounted on a rotating plate and controlled by means of cams so as to give rise to a complicated movement, comprising lapping on a glueing roller, abutting against the first label of the store and then transferring said label to the applicator drum. However, even with the known devices of this type limitations to the operation speed are encountered, because of the forces of inertia due to the complexity of the vanes movement, and also because the vanes are mounted peripherically on the rotating plate and therefore they follow a large radius trajectory and are subjected to a high centrifugal force which, beginning from a certain speed, results in detachment of the conveyed labels. Even within the available speed limits, these devices give rise to vibrations and noise and have a reduced life owing to the overloads which are applied to the components.

SUMMARY OF THE INVENTION

The object of this invention is to provide a device intended to be incorporated into a labelling machine with the purpose of extracting the labels one by one from a stationary store while providing them with glue, and transferring the labels to a rotating applicator drum, in which the moving parts perform relatively simple movements, are free from high accelerations and follow trajectories of reduced radius, so as to minimize the forces of inertia and the centrifugal force, as well as the vibrations and noise, and to allow obtaining higher operative speeds.

The stated object is attained, according to the invention, by the fact: that the device comprises a single transfer member formed by at least two curved plates rigidly connected to one another and uniformly spaced from one another, having their generatrixes parallel to the frontal plane of the label store, said transfer member being situated in a space comprised between the stationary store, the rotating applicator drum and a rotating glueing roller; that said transfer member is mounted freely rotatable on a crank support rotating about an axis parallel to said generatrixes, and it is connected in rigid rotational relationship to a crown of rollers engaging a stationary cam with concave lobes, having a number of lobes higher than the number of said rollers, the maximum radius of said cam being equal to the outer radius of the crown of rollers plus the eccentricity of said crank; and that the distances between the mentioned parts, their rotational speeds and the profile of the cam are chosen in such a manner that each plate of the transfer member, during a first phase of its movement, slides without substantial slip in contact with the glueing roller, thus becoming covered with glue; thereafter, in a second phase, it abuts by one of its ends against the first label of the store and then rolls on the same, without substantial slip, thus adhering to this label and removing the same from the store; and finally, in a third phase, it abuts by one of its ends against the applicator drum and then rolls thereon, without substantial slip, thereby transferring to the drum the conveyed label.

During the rotation of the crank support of the transfer member, the crown of rollers, which is connected thereto in rigid rotational relationship, engages the lobes of the stationary cam, the number of which is larger than that of the rollers, and therefore the transfer member rotates on itself in a direction opposite that of the support, at a periodically varying angular speed depending on the profile of the concave lobes of the cam; the composition of the rotation of the transfer member itself and the opposite rotation of its crank support allows to obtain some instants in which the generatrixes of the curved plates of the transfer member are stationary, when they are in contact with the label to be extracted, as well as some instants in which the tangential velocity of said generatrixes identificates with the tangential velocity of the applicator drum and the glueing roller respectively, when said generatrixes are in contact with said respective members, and accordingly a correct operation of the device can be obtained, even though with very limited deviations from the uniformity in the rotation of the transfer member itself, and hence with very reduced accelerations. On the other hand, the distance between the curved plates forming the transfer member may be kept very reduced, and consequently also the centrifugal force which tends to detach the label from the transfer member remains very reduced. The whole of these conditions allows obtaining high speeds of operation without overloading the components nor giving rise to vibrations and noise.

Preferably, in a device provided with a transfer member having a number p of curved plates and a crown of n rollers, the concave lobes of the stationary cam are in a number N such that $N=n(1+1/p)$. In this way, for each complete turn of the crank support the transfer member performs in the opposite direction a fraction of turn corresponding to the number of plates which forming the transfer member, and therefore it returns to a position identical to the starting position, but with its plates mutually exchanged. This allows to semplify the transmission ratios among the various rotating components of the machine.

Preferably, said curved plates of the transfer member are in number of two and are disposed opposite to one another, and said cam with concave lobes has a number of lobes equal to 1.5 times the number of rollers of the rollers crown. In this way a particular constructive simplicity and the reduction to the minimum of the dimensions of the device are attained.

BRIEF DESCRIPTION OF THE DRAWINGS

The characteristics and advantages of the subject of this invention will be more clearly apparent from the following description of an embodiment, given by way of a non limiting example and diagrammatically shown in the annexed drawings, in which.

DETAILED DESCRIPTION OF THE PREFERRED EMBODIMENT

Figure 1:
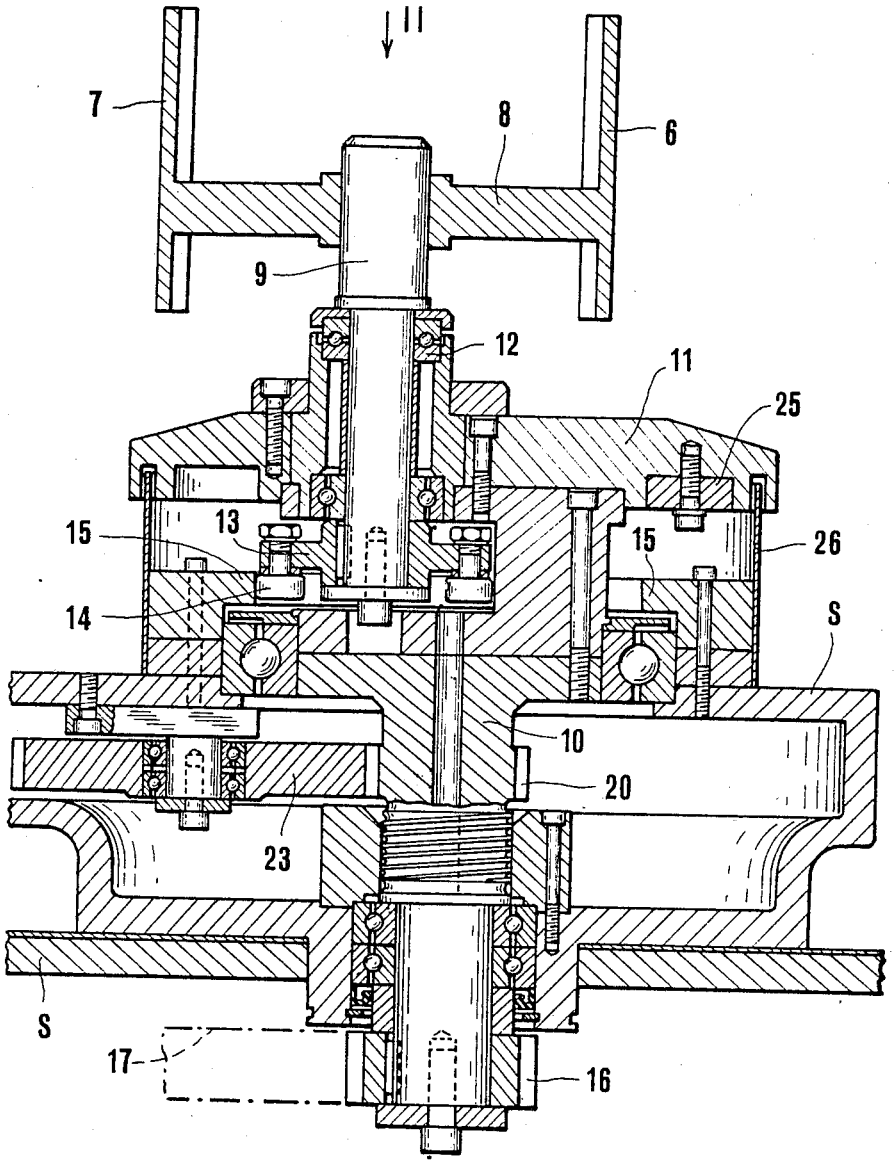
FIG. 1 shows on a reduced scale a cross-sectional view of a label transfer device, taken along plane I—I of FIG. 2, which passes through the rotation axes of the transfer member and of its crank support.
Figure 2:
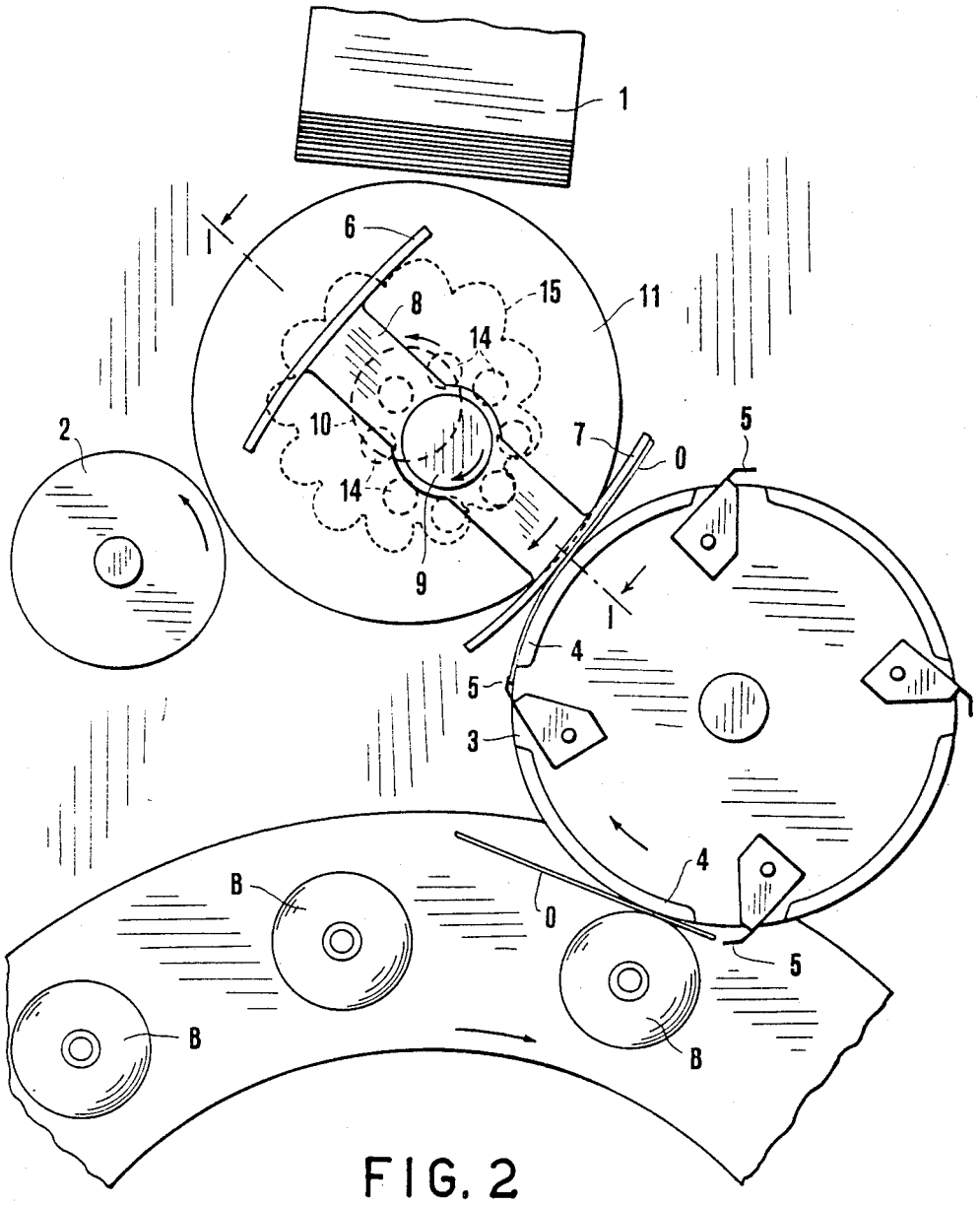
FIG. 2 is a diagrammatical view of the device as seen in the direction of said axes, according to arrow II of FIG. 1.

Referring firstly to FIG. 2, only the relevant parts of the labelling machine in which the label transfer device is intended to be incorporated are shown, i.e. the label store 1, fastened to the structure of the machine, a glueing roller 2 and an applicator drum 3 peripherically provided with pads 4 and pliers 5 for retaining the labels and applying them onto bottles B which are fed, for example, on a trunnion type fixture. These parts of the labelling machine are neither shown nor described in more detail, because they are generally well-known per se and do not require to be modified for actuating the invention. The transfer device according to the invention is disposed in the space comprised among the label store 1, the glueing roller 2 and the applicator drum 3.

In the embodiment shown, the trasfer device comprises two plates 6, 7 rigidly connected to one another through a bridge 8 and mounted on a shaft 9. The plates 6 and 7 are disposed opposite to one another, are curved with their convexity turned outwards, and their generatrixes, as well as the axis of shaft 9, are parallel to the frontal plane of the label store 1. In the practice, in most applications, said frontal plane of the store (to which corresponds the first label contained in the store) is vertical, and said generatrixes and axis are vertical too.

Figure 5:
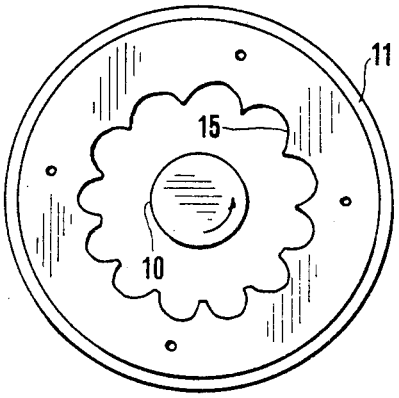
FIG. 5 shows the profile of the stationary cam with concave lobes.
Figure 6:
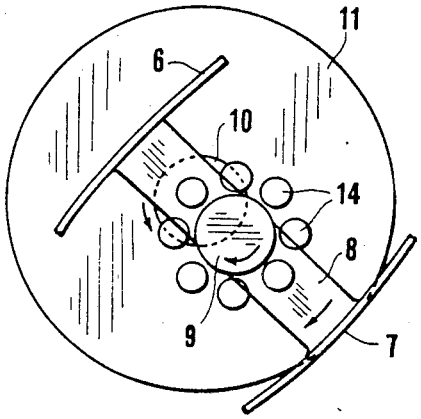
FIG. 6 shows the transfer member with the crown of rollers intended to engage the cam shown in FIG. 5, as it would appear should the members interposed between the transfer member and the crowm of rollers be transparent.

The shaft 9 is eccentrically supported, like a crank, by a support shaft 10. Constructively, as shown in FIG. 2, the shaft 10 may carry a circular plate 11, in an eccentric bearing 12 of which there is supported the freely rotatable shaft 9 which carries the plates 6 and 7. Mounted on the lower end of the shaft 9 there is a disc 13 having, arranged thereon in the shape of a crown, a number (in this case eight) of idle rollers 14. The disposition of these parts relative to each other is particularly apparent from FIG. 6, wherein, for more clarity of representation, the circular plate 11 and other members interposed between the transfer member 6–8 and the rollers 14 are considered as transparent. The rollers 8 engage the concave lobes of a cam 15, fixedly mounted on the structure S of the labelling machine, in which structure the support shaft 10 is pivoted. The configuration of the cam 15 with concave lobes is particularly apparent from FIG. 5. For its correct co-operation with the crown of rollers 14, the cam develops in a substantially concentric manner with respect to the shaft 10, and its outer radius is equal to the sum of the outer radius of the crown of rollers 14 plus the eccentricity of the shaft 9 relative to the support shaft 10. The number of the concave lobes of the cam 15 must be higher than the number of the rollers 14 forming a crown; in the embodiment shown, the cam 15 has twelve lobes.

Figure 3:
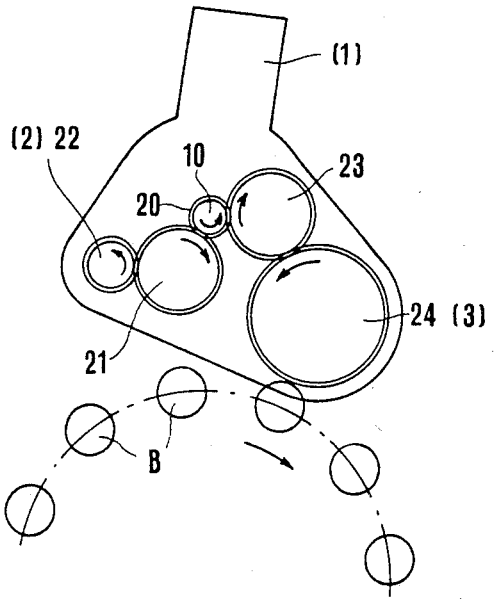
FIGS. 3 and 4 show, on a more reduced scale, the diagram of the transmission means inserted among the various parts of the device.
Figure 4:
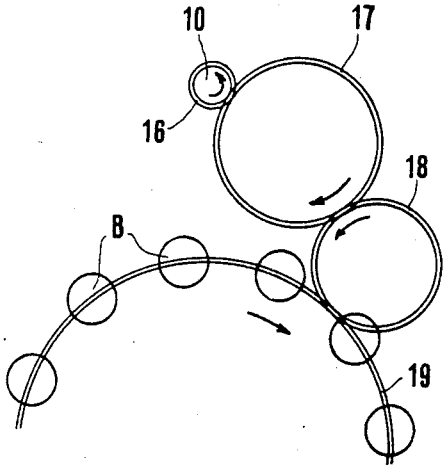

The support shaft 10 is connected to the actuating mechanisms of the labelling machine. In particular, in a possible embodiment, shown by the diagrams of the FIGS. 3 and 4, a gear 16 keyed on the shaft 10 is connected, through gears 17 and 18, to a crown gear 19 rigidly connected to the trunnion type fixture which conveys the bottles B to be labelled; moreover, another gear 20 keyed on the shaft 10 is connected, through a gear 21, to a gear 22 rigidly connected to the glueing roller 2, and is connected as well, through a gear 23, to a gear 24 rigidly connected to the applicator drum 3. Of course, the choice of suitable ratios between the various gears mentioned hereinabove allows obtaining the most appropriate ratios between the angular velocities of the various components.

Advantageously, the circular plate 11 and the annexed parts are arranged so as to balance the eccentric assembly of the transfer member, in view of ensuring a regular rotation. In addition, advantageously, the plate 11 is arranged in such a manner that it can receive additional counterweight elements, such as the element 25, for setting up the balancing. The assembly formed by the described parts is disposed between the machine structure S and the circular plate 11, and a perimetral wall 26 encloses and protects this assembly.

The operation of the device is as follows. As a consequence of the rotation of the support crank shaft 10, the crown of rollers 14 is driven in an orbital movement about the axis of shaft 10, whilst the rollers 14 engage the concave lobes of the cam 15. Since the number of these lobes is greater than that of the rollers, it follows that the crown of rollers 14, along with the shaft 9, receives a rotation which is retrograde with respect to that of the shaft 10. More particularly, the crown of rollers performs, for each complete turn of the shaft 10, a retrograde turn fraction equal to $(N-n)/n$, if n is the number of rollers of the crown and N the number of lobes of the cam. In particular, with the arrangement shown, the crown of rollers performs a half turn rearwards for each forward turn of the shaft 10. This means that after every complete turn of the shaft 10 the device again reassumes its initial configuration, but with the two plates 6 and 7 mutually exchanged. More generally, if the transfer member comprises p plates, the same condition can be obtained, provided that the number N of the lobes of cam 15 is $N=n(1+i/p)$, wherein i is an integer, preferably equal to 1. It is advantageous that the cited condition be respected, because it allows to use simple transmission ratios between the movable components of the machine.

The retrograde rotation of the shaft 9 does not take place with an exactly uniform angular velocity: this velocity is determined by the profile of the concave lobes of cam 15 and may be chosen in different manners in connection with the various parts of the displacement of shaft 9, in order to obtain the most favourable conditions of operation, as it will be explained later on. However, the deviations of the angular velocity of the shaft 9, with respect to a uniform value, always remain very reduced.

Figure 9:
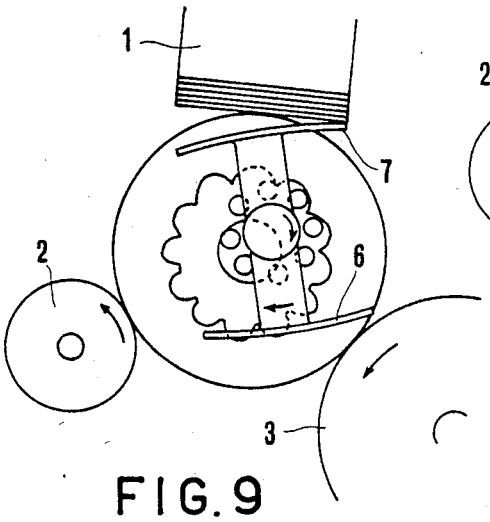
FIGS. 7 to 10 show, on a more reduced scale, the configuration of the device in four successive phases of the operation.
Figure 10:
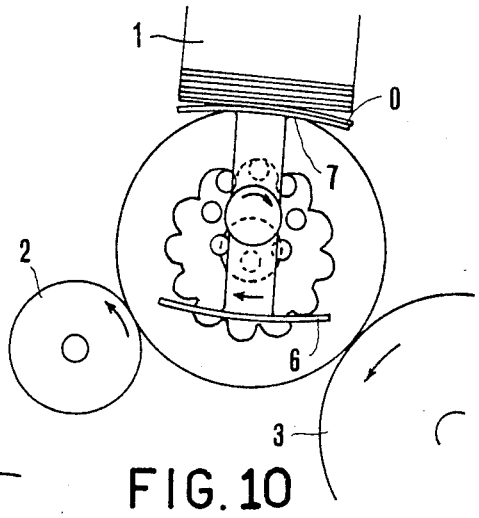
Figure 7:
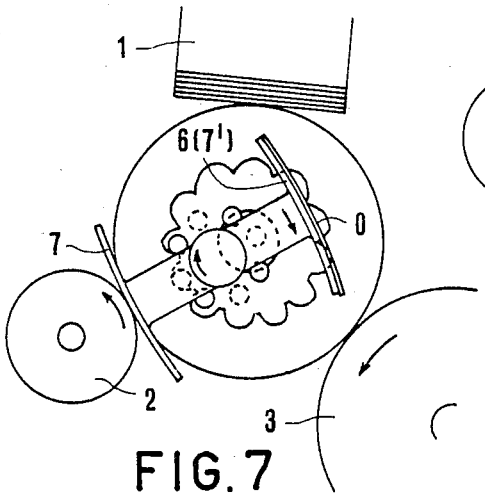
Figure 8:
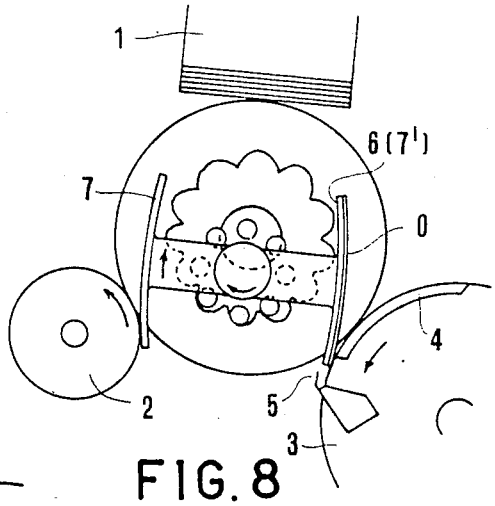

Starting, for example, from the position shown in FIG. 2, in which the curved plate 7 is shown in contact with the applicator drum 3, and by applying to the shaft 10 a counterclockwise rotation, the shaft 9 performs an orbital movement in a counterclockwise direction while rotating about itself in a clockwise direction. Accordingly, the curved plate 7 slides in contact with the applicator drum 3 for its whole extension, then it leaves the applicator drum and moves towards the glueing roller 2, which it laps, thus becoming covered with glue. The centered position of the plate 7 relative to the glueing roller 2 is shown in FIG. 7, and it is attained by rotating the shaft 10 for about $\frac{2}{3}$ of a turn, starting from the position shown in FIG. 2. The successive position, in which the plate 7 is leaving the glueing roller 2, is represented in FIG. 8, and it is attained through a rotation of about 1/6 of a turn, starting from the position shown in FIG. 7. Thereafter, the curved plate 7 moves towards the store 1 and abuts by its own leading edge against an edge of the first label contained in the store; this position is shown in FIG. 9 and is attained through a rotation of about $\frac{1}{3}$ of a turn, starting from the position shown in FIG. 8. Subsequently, the curved plate 7 rolls against the front face of the store 1; the centered position of the plate 7 relative to the store is shown in FIG. 10, and it is attained through a rotation of about 1/6 of a turn, starting from the position shown in FIG. 9. Since the surface of plate 7 is covered with glue, the first label 0 of the store 1 adheres to the plate 7 and, leaving the store, it follows the plate 7 which moves away from this latter. The successive positions which are assumed by the plate 7 can be observed in FIGS. 7 and 8, where however they are represented for the other plate 6: in fact, the device assumes now the same preceding configurations, but with its two plates mutually exchanged. Therefore, plate 7 moves from the store 1 towards the applicator drum 3 (position 7' in FIG. 7: about $\frac{1}{3}$ of a turn beyond FIG. 10) and comes into contact with the applicator drum (position 7' in FIG. 8: about 1/6 of a turn beyond FIG. 7). At this point, in a manner well known per se, the pliers 5 of the applicator drum 3 close, thereby grasping the label 0 conveyed by the curved plate, and, overcoming the adhesion of the glue, detache the label from the curved plate and trail the label towards the bottle 8, to which the label will be applied in a manner well known per se, upon re-opening of the pliers 5. Thus, by a further rotation of about 1/6 of a turn beyond the position 7' in FIG. 8, the device again assumes the configuration shown in FIG. 2, after two complete turns of the support shaft 10. It can be seen that each plate 6, 7 conveys one label every two turns of the shaft 10, that is to say that, since the plates are two in number, a conveyance of one label every turn of the shaft 10 is obtained.

For an optimal operation, the rolling of the curved plates 6, 7 against the first label 0 in the store 1 and against the rotating surfaces of the glueing roller 2 and the applicator drum 3 has to take place at least approximately without slipping; this condition can be attained, or approximated within the desired limits, by appropriately choosing the distances between the various components, the curvature of the plate 6, 7, the transmission ratios and the profile of the lobes of cam 15. Moreover, by a suitable design of the cam it may also be obtained that at least two rollers 14 be always in contact with the cam 15, and that the angular position of the transfer member be kinematically determined without any substantial clearance, whereby the operation becomes constrained and positive. Finally, a correct design of the cam allows avoiding any sudden acceleration, or acceleration variation, of the transfer memebr, thus ensuring an operation free from overloads, vibrations and noise, even at very high speeds.

Since the two (or more) plates of the transfer member are rigidly connected to one another and do not hinder the one another, their distance may be kept very reduced, thus providing a very compact transfer member. This gives rise, on one hand, to a reduction of the centrifugal forces to a minimum, and, on the other hand, to a general reduction of the dimensions of the labelling machine.

The maximum constructive simplicity is obtained by using for the transfer member two plates only, as in the example shown, but, as it has already been stated, it is also possible to employ three or more plates, thus allowing a slower rotation of the support crank shaft, the number of labels conveyed in the unit of time being equal.

Of course, various modifications, in addition to those which have been described above, and every substitution of technical equivalents, may be made to what has been described and illustrated, without departing from the spirit of the invention.

I claim:

1. In a labelling machine intended to label bottles and the like, having a structure and on said structure a stationary store for labels, a rotating glueing roller, an applicator drum, a power source, and transmission means among said power source, said glueing roller and said applicator drum, a device for grasping and transferring the labels from said store to said applicator drum, comprising:

a single transfer member having at least two curved plates rigidly connected to one another and uniformly spaced from one another, said curved plates having generatrixes parallel to the frontal plane of said label store of the machine, said transfer member being situated on said machine structure in the space comprised among said stationary store, said rotating applicator drum and said rotating glueing roller;

a shaft mounted on said machine structure, rotatable about an axis parallel to said generatrixes of said curved plates, a crank support mounted onto said shaft, said transfer member being mounted freely rotatable on said crank support, a crown of rollers connected in rigid rotational relationship to said transfer member, said crown of rollers comprising a number of idle rollers, a stationary cam having a number of concave lobes, mounted on said machine structure and having a number of lobes higher than the number of said idle rollers, said idle rollers of the crown of rollers engaging the concave lobes of said cam, the maximum radius of said cam being substantially equal to the outer radius of said crown of rollers plus the eccentricity of said crank support, and transmission means inserted among said power source and said shaft, whereby each said plate of the transfer member, in a first phase of its movement, slides without substantial slip in contact with said glueing roller, thus becoming covered with glue; thereafter, in a second phase, it abuts by one of its ends against the first label of said store and then rolls on it, without substantial slip, thereby adhering to said first label and removing the same from said store; and finally, in a third phase, it abuts by one of its ends against said applicator drum and then rolls thereon without substantial slip, thereby transferring to said drum the conveyed label.

2. A device as set forth in claim 1, having said transfer member provided with a number p of curved plates and said crown of rollers provided with a number n of rollers, wherein the number N of the concave lobes of said stationary cam is $N=n(1+i/p)$, i being an integer.

3. A device as set forth in claim 1, having said transfer member provided with a number p of curved plates and said crown of rollers provided with a number n of rollers, wherein the number N of the concave lobes of said stationary cam is $N=n(1+1/p)$.

4. A device as set forth in claim 1, wherein said curved plates of the transfer member are in number of two, and said curved plates are disposed opposite to one another.

5. A device as set forth in claim 1, wherein said curved plates of the transfer member are in number of two, said curved plates are disposed opposite to one another, and said stationary cam has a number of lobes equal to 1.5 times the number of rollers of said crown of rollers.

6. A device as set forth in claim 1, wherein said crank support comprises a substantially circular plate mounted onto said shaft, and a bearing eccentrically mounted onto said plate and in which said transfer member is pivoted.

7. A device as set forth in claim 6, wherein said plate of the crank support is arranged to balance the assembly of the trasfer member.

8. A device as set forth in claim 7, wherein said plate of the crank support is arranged to receive additional counterweight elements for setting up of the balancing.

* * * * *